US007007816B2

(12) United States Patent
Verderber

(10) Patent No.: US 7,007,816 B2
(45) **Date of Patent: *Mar. 7, 2006**

(54) CAP WITH ANGLED UPPER SKIRT

(75) Inventor: Rudolph R. Verderber, San Jose, CA (US)

(73) Assignee: Portola Packaging, Inc., San Jose, CA (US)

( * ) Notice: Subject to any disclaimer, the term of this patent is extended or adjusted under 35 U.S.C. 154(b) by 9 days.

This patent is subject to a terminal disclaimer.

(21) Appl. No.: 10/306,766

(22) Filed: Nov. 25, 2002

(65) Prior Publication Data

US 2003/0150834 A1 Aug. 14, 2003

Related U.S. Application Data

(63) Continuation of application No. 09/903,682, filed on Jul. 10, 2001, now Pat. No. 6,499,616, which is a continuation of application No. 09/186,406, filed on Nov. 4, 1998, now abandoned.

(51) Int. Cl.
*B65D 39/00* (2006.01)

(52) U.S. Cl. ..... 215/254; 215/256

(58) Field of Classification Search ..... 215/317, 215/320, 321, 344, 254, 256; 220/780
See application file for complete search history.

(56) References Cited

U.S. PATENT DOCUMENTS 3,209,934 A 10/1965 Salminen
3,254,785 A 6/1966 Lovell
3,392,860 A 7/1968 Faulstich
3,392,862 A 7/1968 Faulstich
3,589,543 A 6/1971 Weigand
3,840,137 A 10/1974 Faulstich
3,979,002 A 9/1976 Faulstich
4,071,156 A 1/1978 Lowe
4,078,696 A 3/1978 Crisci
4,417,666 A 11/1983 Roberts
4,531,650 A 7/1985 Friendship
4,660,735 A 4/1987 Peschardt et al.
4,815,620 A 3/1989 Bullock, III
4,828,128 A 5/1989 Tackles
4,884,707 A 12/1989 Crisci
4,911,316 A 3/1990 Tackles
5,121,846 A 6/1992 Adams et al.
5,224,616 A 7/1993 Crisci
5,232,125 A 8/1993 Adams
5,284,265 A 2/1994 Crisci
5,370,270 A 12/1994 Adams et al.
5,460,283 A 10/1995 MaCartney et al.
5,513,763 A 5/1996 Adams et al.
5,630,520 A 5/1997 Luch et al.
5,662,231 A 9/1997 Adams et al.
5,687,865 A 11/1997 Adams et al.
5,868,281 A 2/1999 Bietzer et al.

(Continued)

*Primary Examiner*—Stephen K. Cronin
(74) *Attorney, Agent, or Firm*—Dorsey & Whitney LLP

(57) ABSTRACT

A bottle cap (10) having a top (12) and a downwardly depending skirt (14). Skirt (14) includes an angled upper portion (20) and a generally cylindrical lower portion (22) with an exterior bead (24) thereon. Angled upper skirt portion (20) extends from a perimeter bead (23) down to a locking bead (34), which allows upper skirt (20) to transfer an application force from perimeter bead (23) radially to locking bead (34) in order to push the locking bead down around the upper crown (42) of a bottle neck (40). A method of applying the bottle cap is also disclosed.

12 Claims, 7 Drawing Sheets

U.S. PATENT DOCUMENTS 5,909,827 A 6/1999 Bietzer et al.
5,911,334 A 6/1999 Helms
5,971,183 A * 10/1999 Bartsch ..... 215/256
5,975,320 A 11/1999 Bietzer et al.
6,082,567 A 7/2000 Bietzer et al.
6,102,226 A 8/2000 Verderber
6,177,041 B1 1/2001 Bietzer
6,499,616 B1 * 12/2002 Verderber ..... 215/254

* cited by examiner

CAP WITH ANGLED UPPER SKIRT

CROSS-REFERENCES TO RELATED APPLICATIONS

This application is a Continuation-in-Part of U.S. patent application Ser. No. 09/903,682, filed Jul. 10, 2001 now U.S. Pat. No. 6,499,616 and entitled CAP WITH ANGLED UPPER SKIRT, which is a Continuation of U.S. patent application Ser. No. 09/186,406, filed Nov. 4, 1998, entitled CAP WITH ANGLED UPPER SKIRT, and now abandoned, the entire contents of which applications are incorporated herein by this reference.

BACKGROUND OF THE INVENTION

1. Field of the Invention

The present invention relates to caps for water bottles and similar containers of various sizes and, more particularly, to an improved upper cap design for simplifying application of the cap onto a bottle neck.

2. Description of Related Art

Current designs for five gallon water bottle closures or caps include a seal bead on the under side of the cap and above a locking bead that biases the seal bead down against the crown of the bottle neck to tightly seal the cap around the crown. The locking bead snaps down and around the upper crown of the bottle neck to concentrate the lower load onto the upper side of the crown and onto a smaller surface region, which raises the surface pressure on the cap and thereby improves the seal. Some caps are provided with foam on the under side of the top panel of the cap, because the foam conforms to irregularities in the crown surface and as a result enhances the effectiveness of the seal.

U.S. Pat. No. 3,979,002 of Faulstich discloses a water bottle cap with no seal bead and which is intended to thread onto a bottle neck. The upper region of the cap has an outwardly angled, somewhat conical shape defined at its lower edge by an external bead that fits around an external upper thread located above the crown. U.S. Pat. No. 3,392,860 also to Faulstich discloses a similar cap design. The design of the upper cap region of the present invention improves upon the cap designs shown in these patents.

Various designs for bottle caps are shown in U.S. Pat. Nos. 3,392,862 and 3,840,137 to Faulstich, and U.S. Pat. No. 4,884,707 to Crisci, which disclose seal bead designs where the seal bead is located beneath the crown of the bottle neck, which requires the seal bead to be completely pushed down beneath the crown. U.S. Pat. No. 4,911,316 to Tackles, U.S. Pat. No. 5,121,846 to Adams et al., and U.S. Pat. No. 5,232,125 to Adams disclose designs where the seal bead engages the top surface of the crown. With these three later designs, the seal bead is generally aligned with the locking bead and, to some extent, increases the frictional resistance generated when pushing the locking bead down over the crown. All of the foregoing patents provide general background information on the state of the art for cap designs.

BRIEF SUMMARY OF THE INVENTION

Briefly described, the improved closure of the present invention includes a top panel for closing off a container neck opening and a skirt depending from the top panel for covering upper side portions of the container neck. A locking bead extends inwardly from the interior side of the skirt at a location spaced from the top panel. The locking bead is adapted to mount underneath the upper crown upon full mounting of the closure on the container neck. The upper portion of the skirt from the locking bead to the top panel is angled inwardly, to direct at least a portion of the application force radially outwardly to assist the locking bead in clearing the upper crown.

According to an aspect of the invention, the locking bead is positioned radially outwardly of the perimeter bead. The upper skirt portion can take on any of a variety of shapes, but preferably is angled in order to efficiently direct the application force to the locking bead. Preferably, the angled upper portion of the skirt is frustoconical.

According to this aspect of the invention, the upper portion of the skirt directs at least a portion of the application force along a path directly outwardly of the upper crown. This assists in pushing the locking bead down around the upper crown of the container neck. The stiffness of the frustoconical upper cap decreases as the angle from vertical increases. An optimum angle can be determined where sufficient stiffness and radially directed force are both achieved.

According to another aspect of the invention, the top panel includes a raised perimeter bead adjacent the periphery of the top panel for receiving an application force to mount the closure onto the neck.

Another aspect of the present invention is directed to a closure for a container of the type having a rounded neck with an upper crown defining a neck opening. The closure includes a top for closing off the neck opening, a skirt depending from the top for covering upper side portions of the neck, a locking bead extending inwardly from and interior side of the skirt at a location spaced from the top, the locking bead adapted to mount underneath the upper crown upon full mounting of the closure on the neck, and a cylindrical lower portion of the skirt extending below the locking bead. The upper portion of the skirt from the locking bead to the top is angled inwardly, to direct at least a portion of the application force radially outwardly to assist the locking bead in clearing the upper crown. The skirt includes a pair of tear lines that extend up into the upper portion of the skirt.

Another aspect of the present invention is directed to a closure for a container of the type having a rounded neck with an upper crown defining a neck opening. The closure includes a top for closing off the neck opening, said top having an applicator contact surface extending around a periphery of the top, an angled upper skirt depending from the top below the applicator contact surface, a cylindrical lower skirt depending from a bottom portion of the angled upper skirt, a locking bead extending inwardly from the intersection of the angled upper skirt and the cylindrical lower skirt, the locking bead adapted to mount underneath the upper crown upon full mounting of the closure on the neck. The angled upper portion forms a substantially straight and uninterrupted path of material between said applicator contact surface and at least a portion of the locking bead.

In one embodiment, the angled upper portion of the skirt is frustoconical having inside and outside surfaces that are at an angle with respect to the cylindrical lower portion of the skirt. The top may include a raised perimeter bead adjacent the periphery of the top for receiving an application force to mount the closure onto the neck and directing the application force directly to the skirt. The locking bead may be positioned radially outwardly of the perimeter bead.

In one embodiment, the closure includes a non-spill central opening and a removable plug. Alternatively, the closure may include a non-spill central well having an opening formed by an inner skirt depending from the top, a bottom closing the opening, and a score line positioned on the bottom. The bottom may include a frustoconical upper portion and a lower portion, wherein the score line extends along the lower portion. The bottom may be concave, wherein the score line extends across the concave lower bottom portion. The bottom may include a frustoconical upper portion and a lower portion, wherein the score line extends across the lower portion. The score line may extend down the frustoconical upper portion and across the lower portion.

The cap with angled upper skirt of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
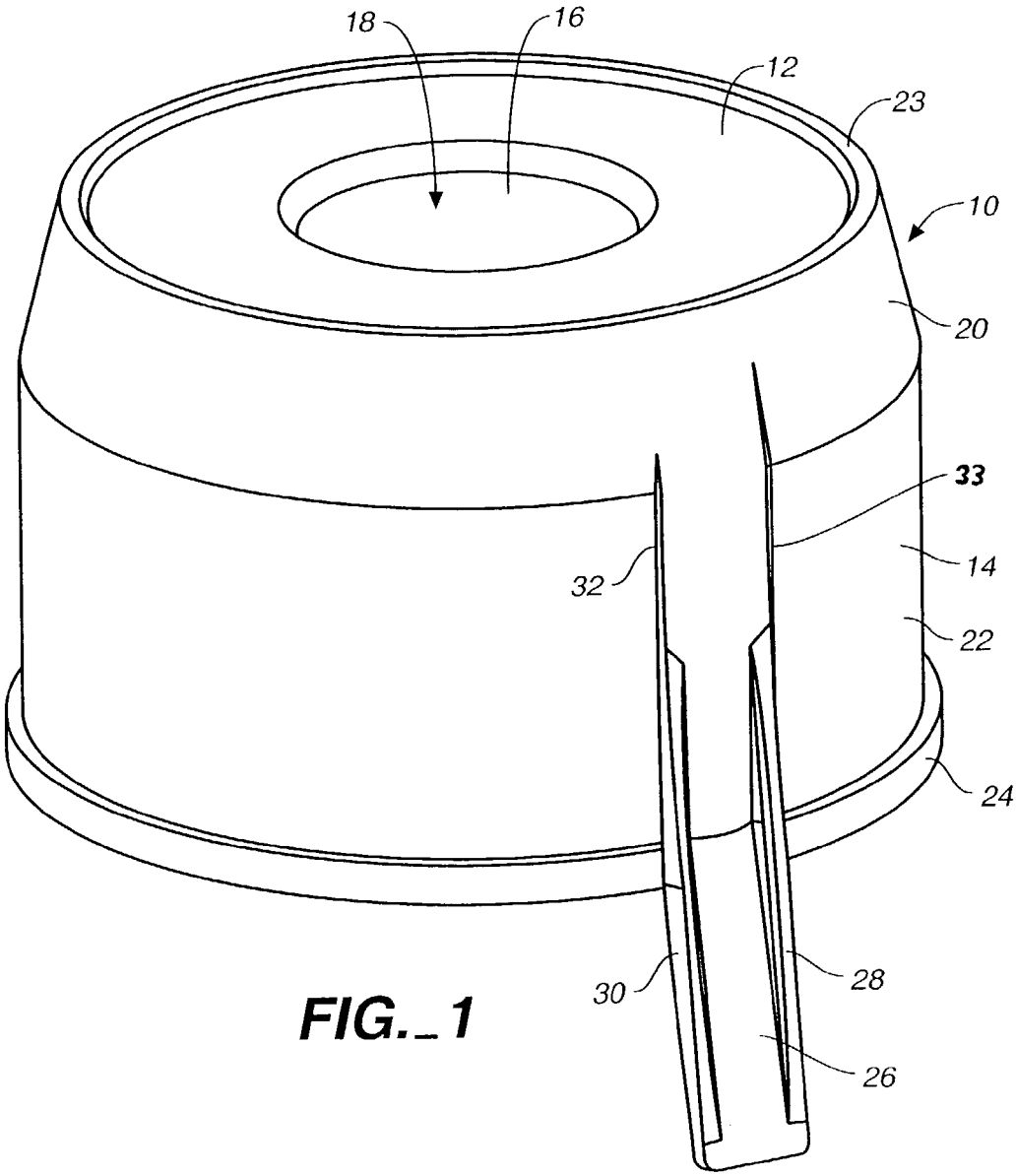
FIG. 1 is a perspective view of a bottle cap of the present invention.

Turning now to the drawings, wherein like components are designated by like reference numerals throughout the various figures, attention is directed to FIG. 1 which illustrates a bottle cap 10 in accordance with the present invention. Bottle cap 10 includes an annular top panel 12 and a cylindrical downwardly depending outer skirt 14. Bottle cap 10 is illustrated as a non-spill cap including a concentric inner skirt 16 forming an opening 18 at the center of the cap. Opening 18 is provided to receive a probe or feed tube of a dispensing unit in a manner that dislodges a plug that is removably mounted at the bottom of inner skirt 16. Non-spill caps and their basic design and operation are well known in the art. However, the present invention is not meant to be limited to non-spill caps and, in fact, the present invention works quite well with any type of generally cylindrical cap, including conventional tear-away caps.

Outer skirt 14 includes an inwardly angled upper portion 20 and a more upright, generally cylindrical lower portion 22. Lower skirt portion 22 is provided as a protective cover for sanitary reasons to prevent dirt and debris from accumulating on the neck region of the bottle. At the upper edge of angled skirt portion 20 is provided a raised perimeter bead 23 that defines an area for applying a stick-on label over opening 18. Raised perimeter bead 23 also provides a point of application for an applicator to press cap 10 onto a bottle neck.

At the bottom edge of lower skirt 22 is provided an annular exterior bead 24 that extends around the lower peripheral edge of skirt 14. As discussed in more detail later, exterior bead 24 provides added rigidity at the lower portion of skirt 14 in order to prevent ovalization.

Cap 10 also includes a downwardly extending pull tab 26. Pull tab 26 includes a pair of side stiffening ribs 28, 30 and has a slight outward cant, formed during formation of the cap, which prevents the tab from interfering in mounting of cap 10 onto the neck of a container. Also, a pair of reduced thickness tear lines 32, 33 are provided, extending from the sides of pull tab 26 up into upper skirt 20. Tear line 33 extends farther up into angled upper skirt 20 than does tear line 32. Tab 26 is provided in order to remove cap 10, either to mount the bottle onto a conventional dispenser that does not include a non-spill feature or to refill the bottle after the contents of the bottle have been dispensed.

Figure 2:
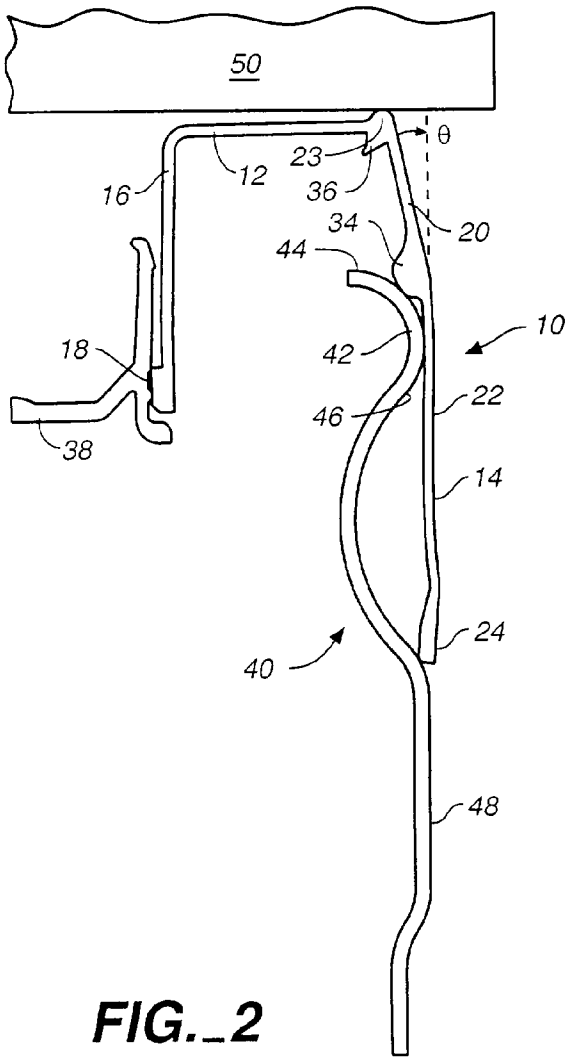
FIG. 2 is a partial cross-sectional view of the cap of FIG. 1 and a bottle neck shown with the cap in position over the bottle neck and an applicator in position to press the cap onto the neck.

Referring to FIG. 2, cap 10 further includes an internal annular locking bead 34 that extends around the interior wall of skirt 14 at the junction of angled upper skirt portion 20 and lower skirt portion 22. A preferable design of locking bead 20 is disclosed in co-pending U.S. patent application Ser. No. 09/169,220, filed Oct. 9, 1998, entitled "INTERNAL LOCKING BEAD DESIGN FOR BOTTLE CAP", and now abandoned. However, the present invention is not limited to a particular locking bead design. It is sufficient that the locking bead perform its function of securing the cap to the bottle.

Bottle cap 10 further includes an annular seal bead 36 that projects inwardly and downwardly and is formed at the junction of angled upper skirt 20 and the outer edge of top panel 12. Also shown in FIG. 2 is half of a plug 38 that mounts within inner skirt 16 to close opening 18. Plug 38 is provided for non-spill caps, which are becoming more widely used in the bottled water industry. For a conventional tear-away cap, plug 38 is not required and inner skirt 16 is eliminated so that top panel 12 comprises a flat circular disc that forms the top portion of the cap and which functions to close and seal the neck opening of a bottle.

In FIG. 2, a portion of a bottle neck 40 is shown. Bottle neck 40 includes an upper crown 42 having an upper side 44 and an underside 46. Bottle neck 40 also includes a lower wide diameter section 48. The lower portion 22 of skirt 14 is designed to extend down around section 48 and form a protective covering for the upper regions of the neck, although this feature is not necessary to the invention. In addition, the particular design of the bottle neck is not essential to the present invention so long as the bottle neck includes a crown or similar wide diameter bead or projection that is designed to receive a locking bead for securing the cap on the neck.

While angled upper skirt 20 of skirt 14 is shown as a frustoconical shape, it is not necessary that the upper skirt 20 take the shape of a frustoconical cone. It is preferable, however, that locking bead 34 be positioned radially outwardly of perimeter bead 23. This creates a radially outwardly directed component of an application force, as discussed with reference to FIGS. 3–6. Angled upper skirt 20 extends from top panel 12 down to locking bead 34 and in this manner assists in directing the application force from perimeter bead 23 to the locking bead 34, as discussed later.

Figure 3:
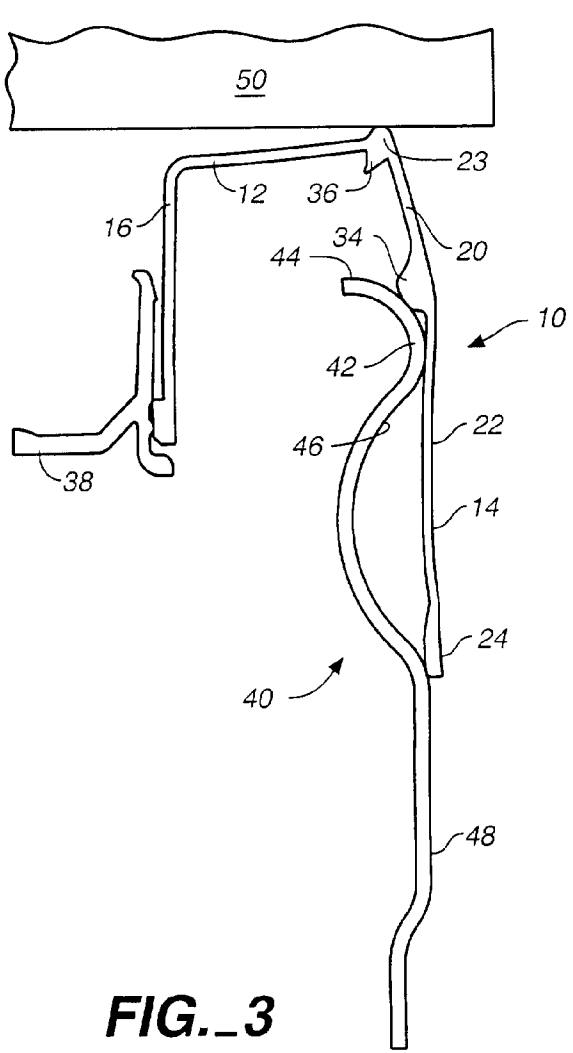
FIG. 3 is a cross-sectional view like FIG. 2, showing the cap being pushed onto the bottle neck.

In FIG. 2, cap 10 is positioned on bottle neck 40 with locking bead 34 against upper side 44 of crown 42. An applicator 50 engages perimeter bead 23 and begins pushing cap 10 onto neck 40. As shown in FIG. 3, applicator 50 has pushed cap 10 downwardly onto bottle neck 40 to the point where locking bead 34 has moved slightly radially outwardly and down the side of upper side 44. The resistance of locking bead 34 against upper crown 42 causes top panel 12 and inner skirt 16 to bend inwardly and downwardly.

Figure 4:
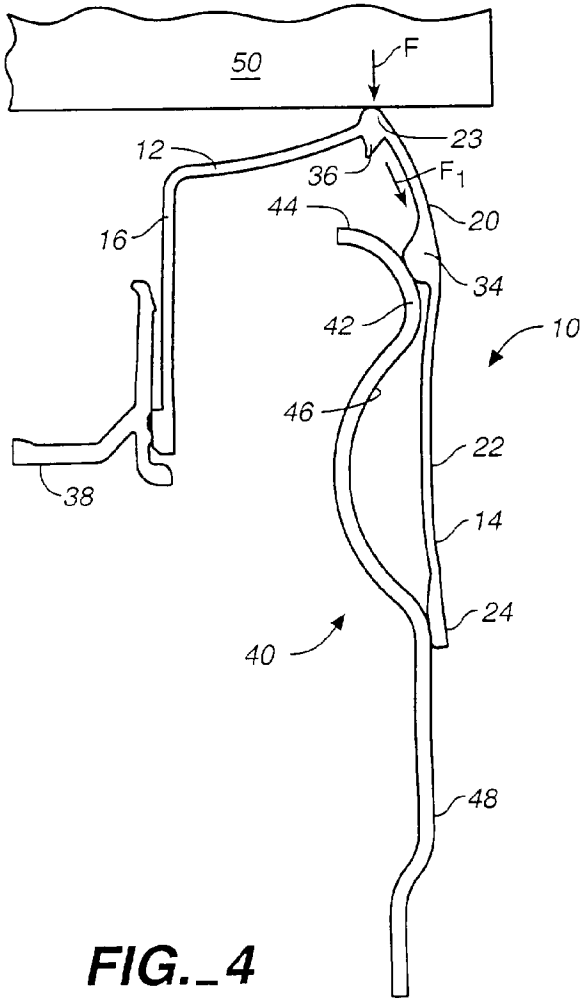
FIG. 4 is a cross-sectional view like FIGS. 2 and 3, showing the locking bead moving down around the upper crown of the bottle.

Referring to FIG. 4, as applicator 50 further presses cap 10 onto bottle neck 40, locking bead 34 moves down toward the outer diameter of upper crown 42, which further increases the resistance created by locking bead 34 and crown 42. With increased resistance, top panel 12 and inner skirt 16 bend further down into the bottle neck opening.

An advantage of the present invention is the design of upper angled skirt portion 20. As the resistance created by locking bead 34 increases, the angled design of upper skirt 20 transfers the application force, shown by arrow F, down through upper skirt 20 and at least partially radially outwardly, as shown by arrow $F_1$. The radial component of force $F_1$ assists in pushing locking bead 34 down around upper crown 42 and the angle of upper skirt 20 creates this radial force component.

Figure 5:
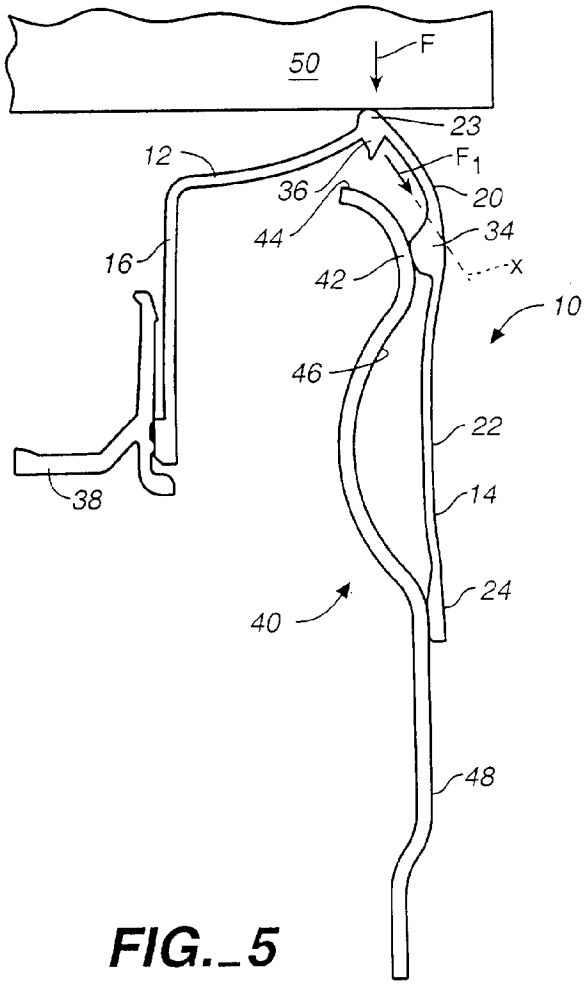
FIG. 5 is a cross-sectional view like FIGS. 2–4, showing the locking bead near its maximum point of clearance.

Referring to FIG. 5, locking bead 34 is pushed outwardly near the maximum clearance at the outside diameter of upper crown 42. At this point, upper skirt 20 begins to bend slightly due to the resistance created by locking bead 34 and upper crown 42. The radial component of force $F_1$ increases as the bending of upper skirt 20 increases, which further assists in pushing locking bead 34 down around upper crown 42. An important feature of upper skirt 20 is its extension from perimeter bead 23 down to locking bead 34 and along a path X directed outwardly of upper crown 42. As a result, force $F_1$ is directed in a manner that assists in pushing locking bead 34 outwardly around upper crown 42.

Figure 7:
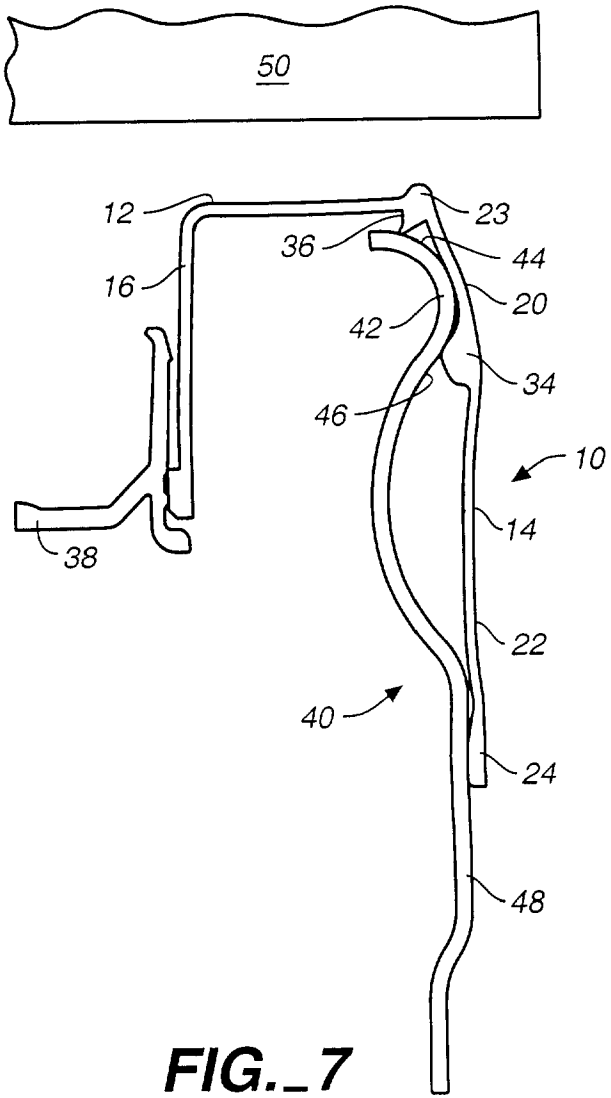
FIG. 7 is a cross-sectional view like FIGS. 2–6, showing the applicator retracted away from the cap.
Figure 6:
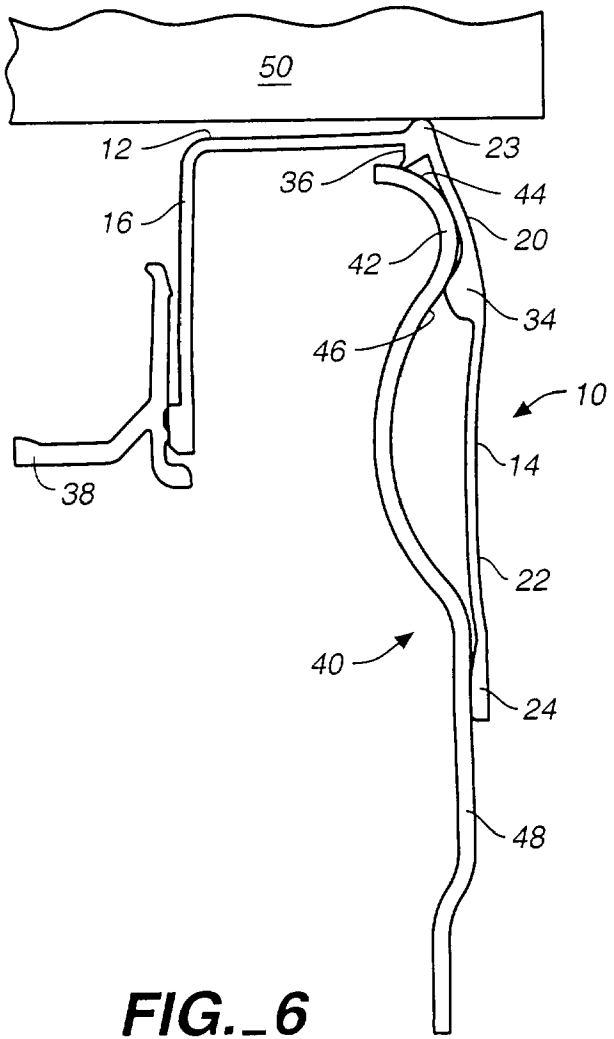
FIG. 6 is a cross-sectional view like FIGS. 2–5, showing the locking bead fully seated past the upper crown and the seal bead pressed against the upper rim of the crown.

Referring to FIG. 6, locking bead 34 has moved down past the maximum point for clearance of upper crown 42 and is engaged against the underside 46 of upper crown 42. Lower skirt 22 covers the upper section of bottle neck 40 and exterior bead 24 is engaged against wide neck section 48. Seal bead 36 is pressed down against upper side 44 of crown 42 and is biased thereagainst by locking bead 34. In this position, cap 10 is securely positioned onto bottle neck 40. As shown in FIG. 7, applicator 50 is retracted and the cap mounting procedure is complete.

Figure 8:
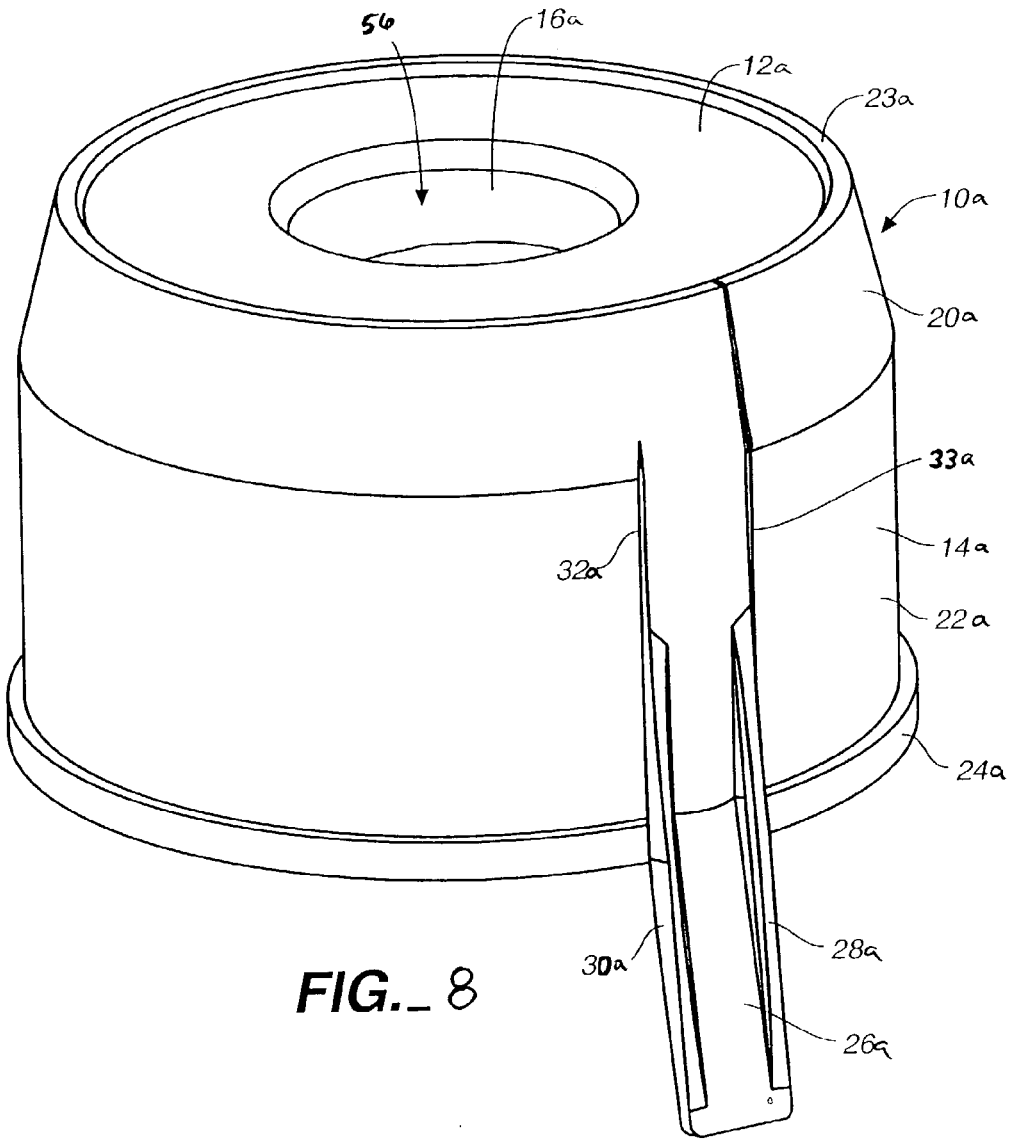
FIG. 8 is a perspective view of a modified bottle cap in accordance with the present invention having a modified well.
Figure 10:
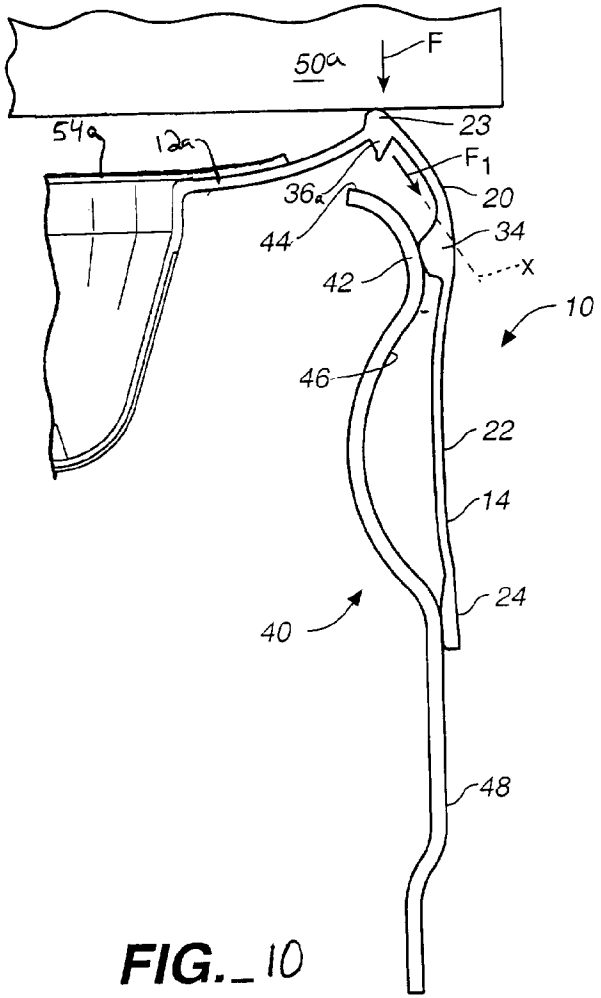
FIG. 10 is a cross-sectional view, similar to FIG. 5, of the modified bottle cap of FIG. 8.

In another embodiment of the present invention, bottle cap 10*a* is similar to bottle cap 10 described above but includes a frangible well 56 as shown in FIG. 8. In some aspects, frangible well 56 is similar to the well that is disclosed by U.S. Pat. No. 5,687,865 to Adams et al., the entire content of which is incorporated herein by this reference. Like reference numerals have been used to describe like components of bottle caps 10 and 10*a*.

With reference to FIG. 8, bottle cap 10*a* includes a top 12*a* for closing off the neck opening of a bottle and an outer skirt 14*a*. Outer skirt 14*a* includes an inwardly angled upper portion 20*a* and a more upright, generally cylindrical lower portion 22*a*. At the upper edge of angled skirt portion 20*a* is provided a raised perimeter bead 23*a* that defines a recessed area for applying a label 54. Raised perimeter bead 23*a* also provides a point of application for an applicator to press cap 10*a* onto a bottle neck in a manner similar to that discussed above. In the embodiment shown in FIG. 8, a pair of tear lines 32*a* and 33*a* are provided, extending from the sides of a pull tab 26*a*. Tear lines 32*a* and 33*a* extend along skirt 14*a* and onto upper skirt 20*a*. In this embodiment, tear line 33*a* extends to the top of upper skirt 20*a* and terminates at a point adjacent perimeter bead 23*a*. One should appreciate that other tear line configurations may be used. For example, one or more tear lines may extend onto the top of the cap in the manner described by co-pending U.S. patent application Ser. No. 09/893,181, filed Jun. 26, 2001 and entitled BOTTLE CAP HAVING TEAR TAB AND SEALING BEAD, and by co-pending U.S. patent application Ser. No. 09/970,534, filed Oct. 3, 2001 and entitled BOTTLE CAP HAVING LINER RETAINER, the entire contents of which applications are incorporated herein by this reference.

Figure 9:
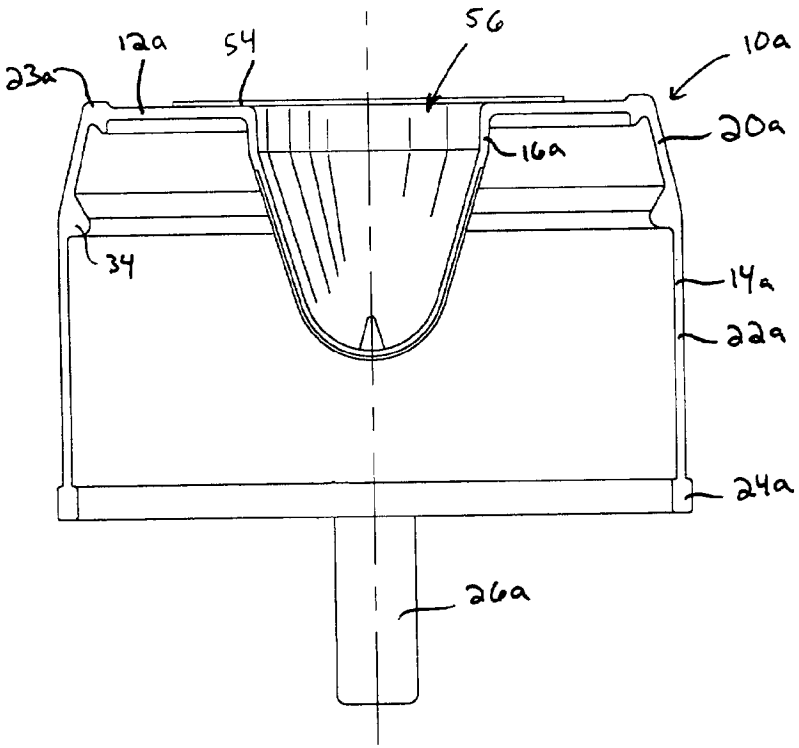
FIG. 9 is a cross-sectional view of the cap of FIG. 8.

With reference to FIG. 9, cap 10*a* includes an internal annular locking bead 34*a* that extends around the interior wall of skirt 14*a* at the junction of angled upper skirt portion 20*a* and lower cylindrical skirt portion 22*a*.

Bottle cap 10*a* may also include an annular seal bead 36*a* that projects inwardly and downwardly and is formed at the junction of angled upper skirt 20*a* and the outer edge of top panel 12*a*. Cap 10*a* may include a downwardly extending pull tab 26*a*, however, one should appreciate that such a pull tab need not be provided. For example, in the event that a bottling facility desires the return of the bottle, after the contents have been dispensed, along with the spent cap still applied to the bottle, well-known automated de-capping equipment may be used at the bottling facility to remove the bottle cap.

In the embodiment illustrated in FIG. 8, bottle cap 10*a* includes an annular top panel 12*a* having a frangible well 56 and a cylindrical downwardly depending outer skirt 14*a*.

Top 12 is formed with a central frangible well 56 for receiving the hollow probe or dispenser tube of a conventional water dispenser. In some aspects, frangible well 56 is similar to that disclosed by U.S. Pat. No. 5,686,865 to Adams et al, the entire contents of which is incorporated herein by this reference.

In the embodiment of FIG. 9, well 56 includes a short cylindrical inner skirt 58 which is closed by a frangible bottom 60. Frangible bottom includes a frustoconical upper portion or side wall 62 depending from inner skirt 58 and a concave bottom portion or rounded bottom 64. Well 56 is formed with an internal score line 66 which is configured to split as a dispenser tube enters well 56.

Score line 66 extends down one side of side wall 62, along rounded bottom downwardly and merging with a second stretch 53 which extends across the bottom 48 and up an opposing side of side wall 62. A rib 68 may be provided on bottom 64 in order to facilitate the tubular probe in contacting and tearing bottom 64 along score line 66.

In the illustrated embodiment, the score line extends within a common diametric plane. One should appreciate, however, that other configurations can be utilized in accordance with the present invention. For example, the score line may include three or more radial legs that converge at a central point on the rounded bottom. Also, the score line need not extend across the center of the rounded bottom but may, instead, extend around the rounded bottom.

The configuration of the frangible well obviates the need for a discrete plug. Namely, the configuration of frangible well 58 allows for a dispenser tube to split frangible bottom 60 as the dispenser tube encounters rib 68 and/or the frangible bottom. Such action causes the frangible bottom to split along internal score line 66 until a portion of the dispenser tube passes through well 58 and enters the bottle, thus allowing water to enter the dispensing tube.

After the contents of the bottle have been substantially depleted, the bottle is removed by lifting vertically upwardly. The split portions of well 62 come together by reason of the resiliency of the plastic material of which cap 10*a* is molded. Well 62 is not restored to its original condition but substantial leakage is inhibited so that spillage of water onto the outside of the dispenser and/or floor is avoided.

Turning again to the configuration of skirt 14*a* as shown in FIG. 9, angled upper skirt 20*a* of skirt 14*a* is frustoconical and extends from perimeter bead 23*a* directly to locking bead 34*a*, which is positioned radially outwardly of perimeter bead 23*a*. Thus, angled upper skirt 20*a* provides a direct, uninterrupted path of material from the applicator contact point of bottle cap 10*a* to locking bead 34*a* through which the application force F may be transferred directly to the locking bead. The path of material is substantially straight and is uninterrupted between perimeter bead 23*a* and an outer portion of locking bead 34*a*. The configuration of upper skirt 20*a* allows for the conversion of at least a portion of the applicator force F to a radially outwardly directed component $F_1$.

For example, as an applicator presses bottle cap 10*a* onto a bottle neck in a manner similar to that discussed above, locking bead 34*a* contacts the upper crown 42, and due, in part, to its elasticity and dimensions, the bottle cap resists passing over the upper crown 42. As the resistance created by locking bead 34*a* increases, the angled design of upper skirt 20*a* transfers the application force, shown by arrow F, down through upper skirt 20*a* and at least partially radially outwardly, as shown by arrow $F_1$. The radial component of force $F_1$ assists in pushing locking bead 34*a* down around upper crown 42 and outwardly around the upper crown.

Once past the maximum point for clearance of upper crown 42, the inherent resiliency of bottle cap 10*a* and locking bead 34*a* facilitates the locking bead to engage against the underside 46 of upper crown 42. Lower skirt 22*a* covers the upper section of bottle neck 40 and exterior bead 24*a* engages against wide neck section 48. Seal bead 36*a* is pressed down against upper side 44 of crown 42 and is biased thereagainst by locking bead 34*a*. In this position, cap 10*a* is securely positioned onto bottle neck 40. Thus, in operation and use, bottle cap 10*a* is used in substantially the same manner as bottle cap 10 discussed above.

Figure 11:
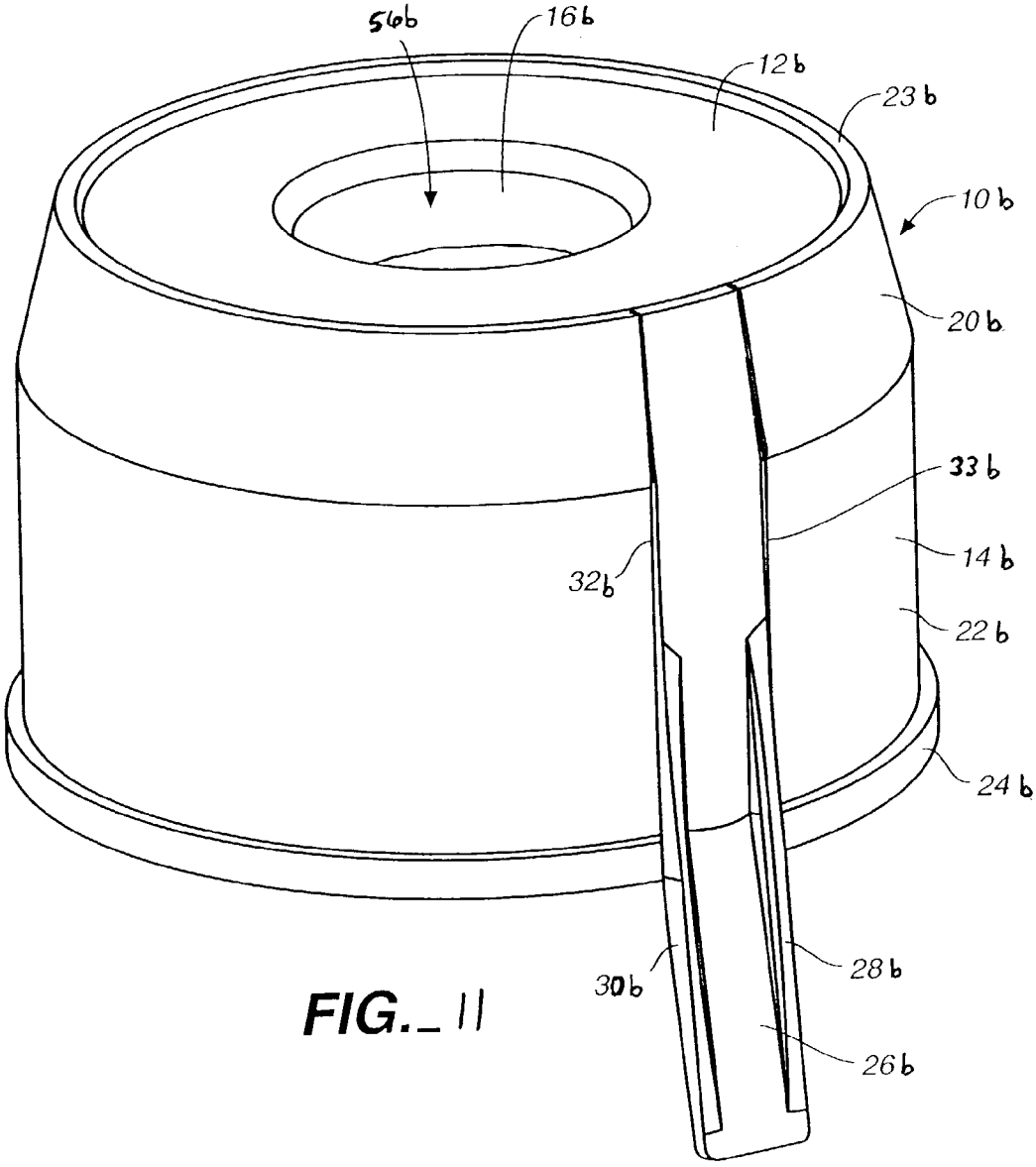
FIG. 11 is a perspective view of another modified bottle cap in accordance with the present invention having a modified well.

In another embodiment of the present invention, bottle cap 10*b* is similar to bottle caps 10 and 10*a* described above but a pair of tear lines which extend up to the top of outer skirt 14*a*, as shown in FIG. 11. In some aspects, tear lines 32*b* and 33*b* are similar to those which are described by co-pending U.S. patent application Ser. No. 09/893,181, filed Jun. 26, 2001 and entitled BOTTLE CAP HAVING TEAR TAB AND SEALING BEAD and by co-pending U.S. patent application Ser. No. 09/970,534, filed Oct. 3, 2001 and entitled BOTTLE CAP HAVING LINER RETAINER, the entire contents of which applications are incorporated herein by this reference. Like reference numerals have been used to describe like components of bottle caps 10, 10*a* and 10*b*.

With reference to FIG. 1, bottle cap 10*b* includes a top 12*b* for closing off the neck opening of a bottle and an outer skirt 14*b*. Outer skirt 14*b* includes an inwardly angled upper portion 20*b* and a more upright, generally cylindrical lower portion 22*b*. In the embodiment shown in FIG. 11, a pair of tear lines 32*b* and 33*b* are provided, extending from the sides of a pull tab 26*b*. Tear lines 32*b* and 33*b* extend along skirt 14*b* and onto upper skirt 20*b*. In this embodiment, tear lines 32*b* and 33*b* both extend to the top of upper skirt 20*b* and terminate at a point adjacent perimeter bead 23*b*. Again, one should appreciate that other tear line configurations may be used. For example, one or more tear lines may extend onto the top of the cap in the manner described by the above-mentioned co-pending '181 and '534 applications. In operation and use, bottle cap 10*b* is used in substantially the same manner as bottle caps 10 and 10*a* discussed above.

For convenience in explanation and accurate definition in the appended claims, the terms "up" or "upper", "down" or "lower", "inside" and "outside" are used to describe features of the present invention with reference to the positions of such features as displayed in the figures.

In many respects the modifications of the various figures resemble those of preceding modifications and the same reference numerals followed by subscript "a" designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A closure for a container of the type having a rounded neck with an upper crown defining a neck opening, comprising:

a top for closing off the neck opening;

a skirt depending from the top for covering upper side portions of the neck;

a locking bead extending inwardly from and interior side of the skirt at a location spaced from the top, the locking bead adapted to mount underneath the upper crown upon full mounting of the closure on the neck; and a cylindrical lower portion of the skirt extending below the locking bead;

wherein the upper portion of the skirt from the locking bead to the top is angled inwardly, to direct at least a portion of the application force radially outwardly to assist the locking bead in clearing the upper crown, and wherein the skirt includes a pair of tear lines that extend up into the upper portion of the skirt, and wherein the closure includes a non-spill central opening and a removable plug.

2. A closure for a container of the type having a rounded neck with an upper crown defining a neck opening, comprising:

a top for closing off the neck opening;

a skirt depending from the top for covering upper side portions of the neck;

a locking bead extending inwardly from and interior side of the skirt at a location spaced from the top, the locking bead adapted to mount underneath the upper crown upon full mounting of the closure on the neck; and a cylindrical lower portion of the skirt extending below the locking bead;

wherein the upper portion of the skirt from the locking bead to the top is angled inwardly, to direct at least a portion of the application force radially outwardly to assist the locking bead in clearing the upper crown, and wherein the skirt includes a pair of tear lines that extend up into the upper portion of the skirt, and wherein the closure includes a non-spill central well having an opening formed by an inner skirt depending from the top, a bottom closing the opening, and a score line positioned on the bottom.

3. The closure of claim 2, wherein the bottom includes a frustoconical upper portion and a lower portion, wherein the score line extends along the lower portion.

4. The closure of claim 3, wherein the bottom is concave, wherein the score line extends across the concave lower bottom portion.

5. The closure of claim 3, wherein the bottom includes a frustoconical upper portion and a lower portion, wherein the score line extends across the lower portion.

6. The closure of claim 5, wherein the score line extends down the frustoconical upper portion and across the lower portion.

7. A closure for a container of the type having a rounded neck with an upper crown defining a neck opening, comprising:

a top for closing off the neck opening, said top having an applicator contact surface extending around a periphery of the top;

an angled upper skirt depending from the top below the applicator contact surface;

a cylindrical lower skirt depending from a bottom portion of the angled upper skirt;

a locking bead extending inwardly from the intersection of the angled upper skirt and the cylindrical lower skirt, the locking bead adapted to mount underneath the upper crown upon full mounting of the closure on the neck; and wherein the angled upper skirt forms a substantially straight and uninterrupted path of material between said applicator contact surface and at least a portion of the locking bead, and wherein the closure includes a non-spill central opening and a removable plug.

8. A closure for a container of the type having a rounded neck with an upper crown defining a neck opening, comprising:

a top for closing off the neck opening, said top having an applicator contact surface extending around a periphery of the top;

an angled upper skirt depending from the top below the applicator contact surface;

a cylindrical lower skirt depending from a bottom portion of the angled upper skirt;

a locking bead extending inwardly from the intersection of the angled upper skirt and the cylindrical lower skirt, the locking bead adapted to mount underneath the upper crown upon full mounting of the closure on the neck; and wherein the angled upper skirt forms a substantially straight and uninterrupted path of material between said applicator contact surface and at least a portion of the locking bead, and wherein the closure includes a non-spill central well having an opening formed by an inner skirt depending from the top, a bottom closing the opening, and a score line positioned on the bottom.

9. The closure of claim 8, wherein the bottom includes a frustoconical upper portion and a lower portion, wherein the score line extends along the lower portion.

10. The closure of claim 9, wherein the bottom is concave, wherein the score line extends across the concave lower bottom portion.

11. The closure of claim 9, wherein the bottom includes a frustoconical upper portion and a lower portion, wherein the score line extends across the lower portion.

12. The closure of claim 11, wherein the score line extends down the frustoconical upper portion and across the lower portion.

* * * * *